US007272995B1

(12) United States Patent
Mavin

(10) Patent No.: US 7,272,995 B1
(45) Date of Patent: Sep. 25, 2007

(54) JIG HAMMER

(76) Inventor: W. H. Douglas Mavin, 190 O'Neil Drive, Garson, Ontario (CA) P3L 1G8

( * ) Notice: Subject to any disclaimer, the term of this patent is extended or adjusted under 35 U.S.C. 154(b) by 0 days.

(21) Appl. No.: 11/486,016

(22) Filed: Jul. 14, 2006

(51) Int. Cl.
*B25D 1/00* (2006.01)

(52) U.S. Cl. ..... 81/20; 81/489; 81/490

(58) Field of Classification Search ..... 81/20, 81/489, 490
See application file for complete search history.

(56) References Cited

U.S. PATENT DOCUMENTS 1,109,507 A * 9/1914 Bostock ..... 81/23
3,119,424 A * 1/1964 Henry ..... 81/20
5,099,724 A * 3/1992 Reddy, Jr. ..... 81/20

* cited by examiner

*Primary Examiner*—Joseph J. Hail, III
*Assistant Examiner*—Shantese McDonald
(74) *Attorney, Agent, or Firm*—M. Gauthier

(57) ABSTRACT

A carpenter's hammer wherein the handle portion is telescopic using two slidably mating tubes. Two optimal preset positions are made possible by means of a dual spring-nipple. At the 14.5" stop, the jig hammer can be used to jig the position between studs for 16" on center. At the 16" stop, the jig hammer can be used to mark stud locations on wall plates prior to nailing, as well as to locate studs once panel board covers these studs. A built-in safety bar serves as a positional stop, and also to prevent separation of the two telescopic handle portions. A pencil holder at the extremity of the handle portion positions a pencil through the handle in such a manner as to allow marking at the very end of said hammer.

5 Claims, 3 Drawing Sheets

JIG HAMMER

FIELD OF THE INVENTION

The present invention relates to a carpenter's hammer wherein the handle portion is telescopic using two slidably mating tubes. Two optimal preset positions are made possible by means of a dual spring-nipple. At the 14.5" stop, the jig hammer can be used to jig the position between studs for 16" on center. At the 16" stop, the jig hammer can be used to mark stud locations on wall plates prior to nailing, as well as to locate studs once panel board covers these studs. A built-in safety bar serves as a positional stop, and also to prevent separation of the two telescopic handle portions. A pencil holder at the extremity of the handle portion positions a pencil through the handle in such a manner as to allow marking at the very end of said hammer.

BACKGROUND OF THE INVENTION

In modern framing practices, the most common spacing is still today 16", and typical framing material has a width of 1.5" thus when these materials are placed at 16" on center, the distance between these members would indeed be 14.5".

Accordingly, when framing a wall for instance, it would be desirable to easily space the studs at 16" on center or 14.5" therebetween without the need to use another tool. And whence nailing panels onto a stud wall, it would be desirable to easily locate hidden studs also without such additional tools.

Furthermore, as an incorporated benefit, the hammer's length can be adjusted to better-fit user's preference.

The applicant is aware of several attempts in prior art to provide means of also using a hammer as a measuring device. For example, reference may be had to U.S. Pat. No. 4,732,058 of Chung, issued Mar. 22, 1988, which describes a hammer having measurements normally used in the construction field, as well this hammer incorporates a nail holding aperture. However, this lacks many of the features of the hammer of the present invention.

SUMMARY OF THE INVENTION

It is thus the object of the present invention to provide users with a hammer that is not only fully functional as the common hammer, but one that is safely extendable from 14.5" and 16" in length, and has pencil-holding capabilities so as to enable scribing therewith.

In one aspect of the invention, the handle portion may have a square or rectangular profile.

In another aspect of the invention, the hammer's balance weight may be any between 12 and 30 ounces.

Accordingly, the jig hammer of the present invention allows not only the function of a conventional hammer, but also includes a telescopic handle for optimal jig measurements, and scribing means.

While the present invention is primarily described in conjunction with wall studs, it must be understood that roof rafter, floor joists or the like shall be included within the scope of the invention.

BRIEF DESCRIPTION OF THE DRAWINGS

These and other advantages of the invention will become apparent upon reading the following detailed description and upon referring to the drawings in which.

Figure 1:
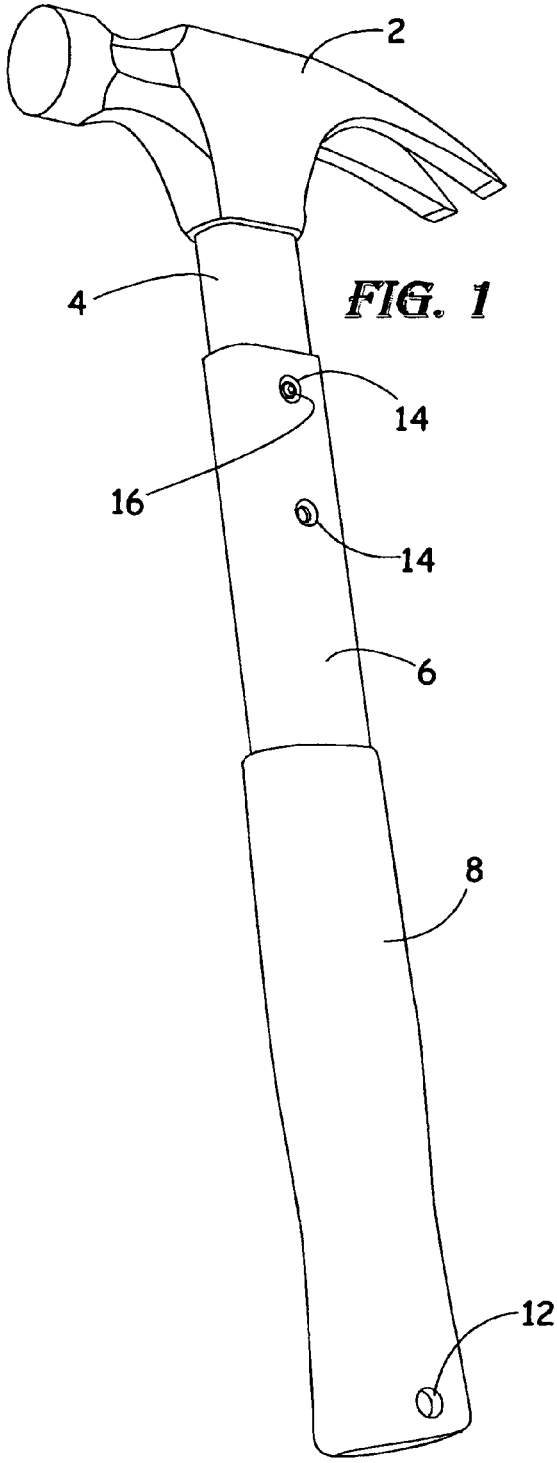
FIG. 1 is a perspective view of the jig hammer of the present invention in an extended arrangement.

While the invention will be described in conjunction with illustrated embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE PREFERRED EMBODIMENT

In the following description, similar features in the drawings have been given similar reference numerals.

Figure 2:
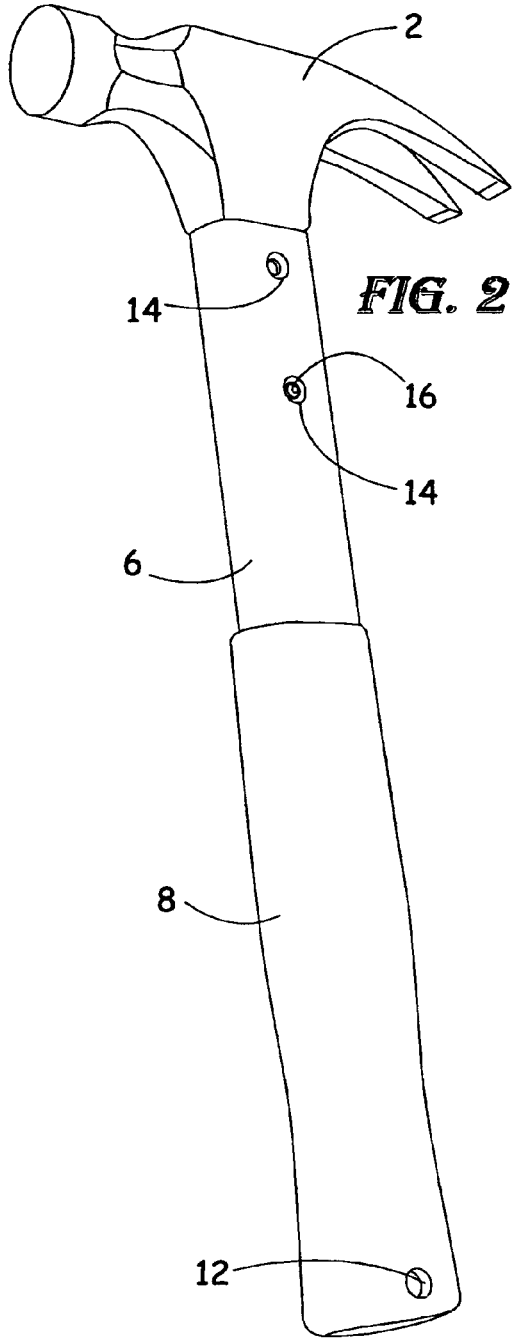
FIG. 2 is a perspective view of the jig hammer of the present invention in a collapsed arrangement.

Turning to FIGS. 1 and 2, which illustrate a perspective view of the jig hammer of the present invention wherein FIG. 1 is shown extended, and FIG. 2 is shown collapsed. The invention comprising: a hammerhead 2, an inner handle 4, an outer handle 6, and a handle grip 8. The inner handle 4 is slidably movable within a hollow outer handle 6. Said inner handle 4 incorporates a dual spring-nipple 16 where said nipples 16 traverse a pair of aligned perforations near the neck area of said inner handle 4. Same dual spring-nipples 16, when aligned with similar perforation 14 in the outer handle 6, latch both handles 4 and 6 at two strategic positions.

Again in both FIGS. 1 and 2, a pencil holder is incorporated at the extremity of the outer handle 6 distal from the hammerhead 2. A pencil can there be placed traversing the outer handle 6 and handle grip 8 so as to protrude slightly thus allowing marking onto a surface when so desired.

Figure 3:
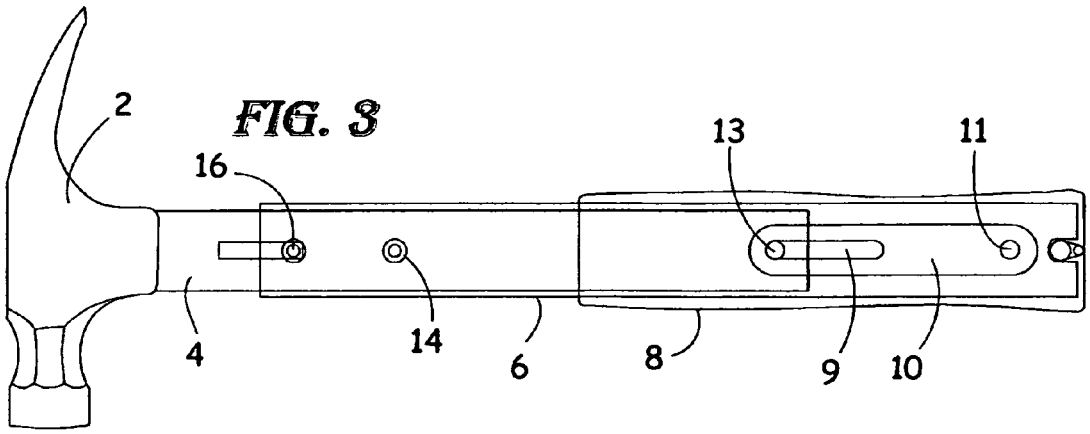
FIG. 3 is a partially transparent top view of the jig hammer of the present invention in an extended arrangement.
Figure 4:
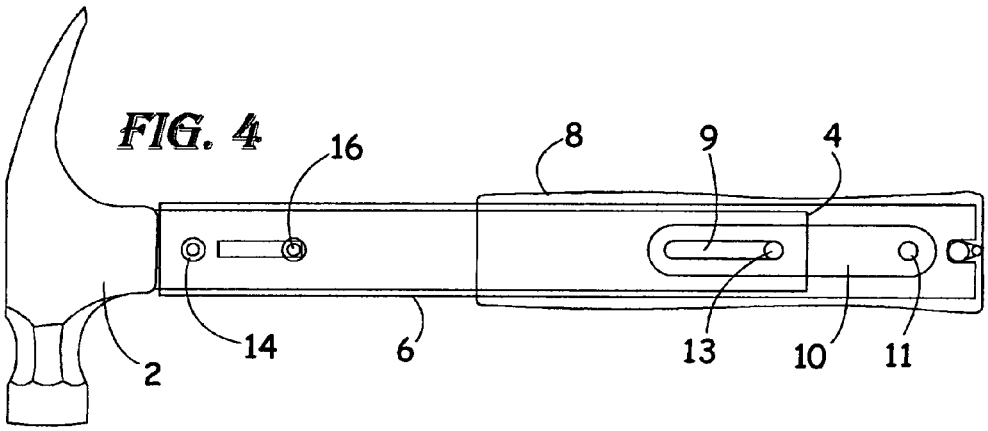
FIG. 4 is a partially transparent top view of the jig hammer of the present invention in a collapsed arrangement.

Turning now to FIGS. 3 and 4, both partially transparent views wherein the present jig hammer is depicted extended in FIG. 3 and collapsed in FIG. 4. The dual spring-nipples 16 can be seen in a fixed position within the inner handle 4, and the perforations 14 through the outer handle 6 thereby latchedly engage the dual spring-nipples 16 when in alignment therewith.

Again in FIGS. 3 and 4, a safety bar 10 is depicted having one hole at one end, and a lengthwise slot 9 at the other end of said bar 10 wherein, the bar 10 is fixedly positioned with the outer handle 6 by way of a first pin 11 traversing the hole in said bar 10 and engaged within similar size holes through two sides of the outer handle 6. Conversely, a second pin 13 traversing the elongated slot 9 within the safety bar 10 and engaged within holes in the inner handle 4, limits the longitudinal motion of the outer handle 6 in relation to the inner handle 4 to the length of said slot 9 less the second pin's 13 diameter. Therefore, in the event that the spring-nipples 16 fail to hold their position, the safety bar 10 will retain the handles 4 and 6 together.

Figure 5:
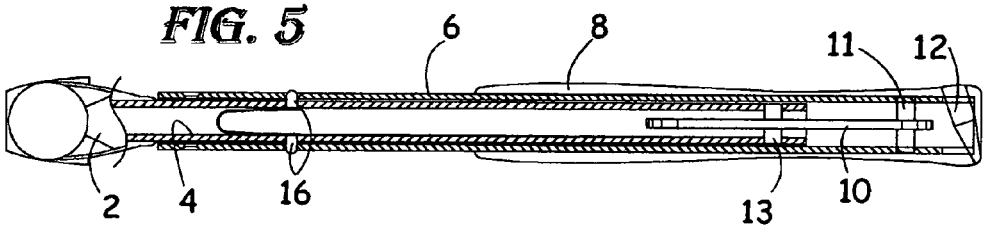
FIG. 5 is a partial cross-sectional view of the jig hammer of the present invention in a collapsed arrangement.

FIG. 5 depicts a partial cross-sectional side view of the jig hammer of the present invention wherein the dual spring-nipple 16 can be better seen in a latched position.

Assembly of the present jig hammer begins with the fixed mating of the hammerhead 2 and the inner handle 4. Then, the spring-nipples 16 get positioned. The safety bar 10 gets inserted in the inner handle 4 while the second pin 13 gets placed through the inner handle and the elongated slot 9 of the safety bar 10. The outer handle 6 slides over the inner handle 4 thereby confining the second pin 13 from egress, and a first pin 11 gets placed through the holes of the outer handle 6 distal from the hammerhead 2 and through the hole within the safety bar 10 so as to fix the position of the bar 10 in relation to the outer handle 6. The semi-resilient handle grip 8 then gets slid over the outer handle 6 so as to also confine the first pin 11 from egress.

Figure 6:
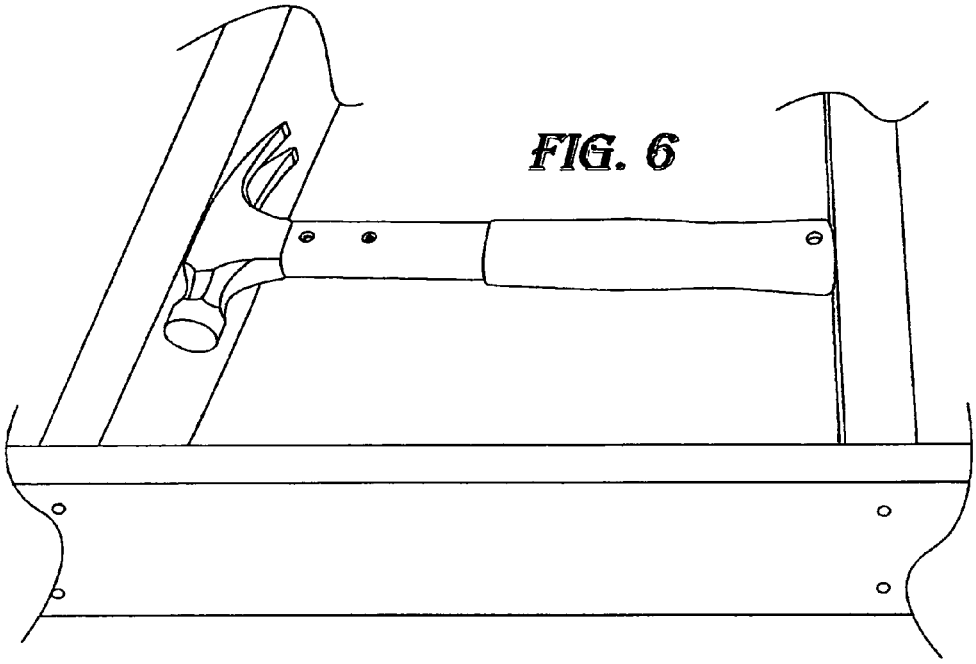
FIG. 6 is a perspective view of the collapsed jig hammer of the present invention as used as a stud spacing jig.

Turning to FIG. 6, which illustrates the jig hammer in a collapsed arrangement where this hammer length of 14.5" is conducive to optimal centering of 1.5" width framing members thus making it easier and faster to frame and erect a stud wall. When using a pneumatic nailer, the jig hammer can be positioned to place the stud being nailed in position thereby freeing a hand from a vulnerably dangerous position. Conversely, whence hammering manually, said jig hammer can be removed once stud is positioned and secured with say, one's foot, or a mark can be made to locate the stud's position.

Figure 7:
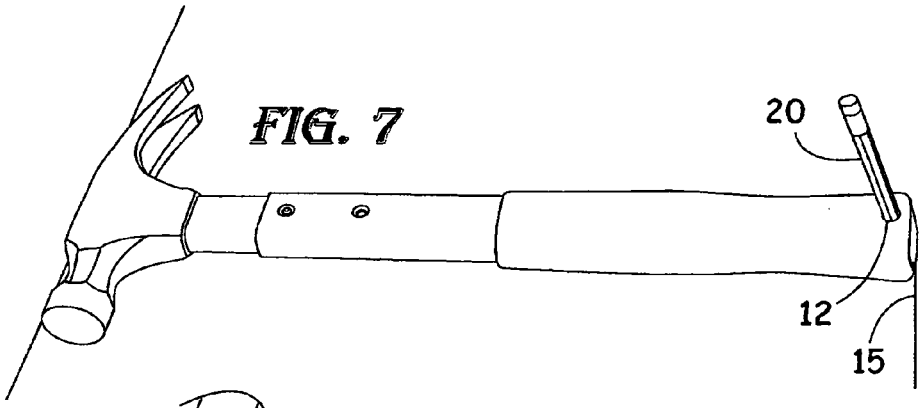
FIG. 7 is a perspective view of the extended jig hammer of the present invention as used for scribing.
Figure 8:
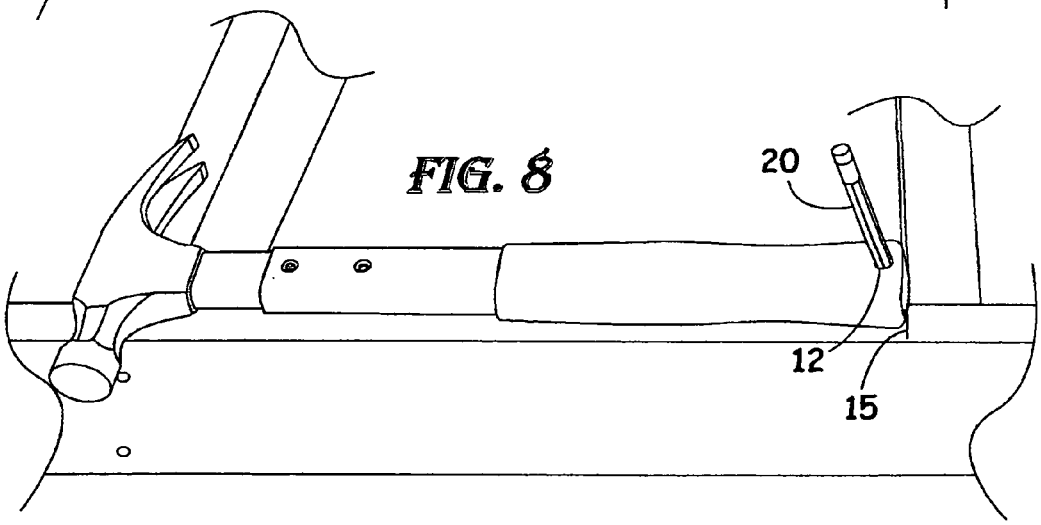
FIG. 8 is a perspective view of the extended jig hammer of the present invention as used for marking wall plates.

FIGS. 7 and 8 depict the jig hammer in an extended arrangement wherein a pencil 20 is engaged into the pencil holder 12 of the jig hammer so as to allow marking or scribing 15 therewith at an optimal distance of 16" thus making it even easier to locate hidden wall studs whence covered by wallboard. Additionally, this arrangement can be used to mark stud locations onto wall plates prior to nailing.

I claim:

1. A jig hammer having an angled circular void at the end of an outer handle distal to a hammerhead is formed to frictionally engage a pencil so as to allow the pencil lead to traverse the handle thus providing marking and scribing means, and said jig hammer further comprising:

a. a hammerhead fixedly attached to a tubular inner handle, b. an outer handle, c. means of adjusting handle length, and d. safety means of preventing handle separation.

2. The jig hammer of claim 1 wherein a hollow outer handle having inner form and dimensions slightly greater that those of the outer form and dimensions of a mating inner handle.

3. The jig hammer of either claim 1 or 2 wherein the inner and outer handles are slidably engaged to one another so as to allow extension and collapse of said handles' length.

4. The jig hammer of wherein the collapsed total length of the jig hammer is 14.5", and the extended total length is 16".

5. The jig hammer of claim 1 wherein a safety bar is provided to limit the longitudinal motion of the inner and outer handles.

* * * * *